United States Patent [19]

Tsamas

[11] Patent Number: 4,829,789

[45] Date of Patent: May 16, 1989

[54] VARIABLE PRESSURE EARRING CLASP

[76] Inventor: Anton Tsamas, 408 Kaplan Ave., Hackensack, N.J. 07601

[21] Appl. No.: 118,582

[22] Filed: Nov. 6, 1987

[51] Int. Cl.[4] ..... A44C 7/00

[52] U.S. Cl. ..... 63/14.3; 24/499; 63/14.5

[58] Field of Search ..... 63/14.3, 14.4, 14.5; 24/499, 511, 513, 515

[56] References Cited

U.S. PATENT DOCUMENTS

| | | | |
|---|---|---|---|
| 1,069,225 | 8/1913 | Boyland | 24/499 |
| 2,013,760 | 9/1935 | McSoley | 63/14.4 X |
| 2,407,098 | 9/1946 | Raiche | 63/14.3 |
| 2,423,905 | 7/1947 | Schuler . | |
| 2,516,652 | 7/1950 | Silverman | 24/499 X |
| 2,550,828 | 5/1951 | Lawson, Jr. et al. | 63/14.3 |
| 2,668,341 | 2/1954 | Arzt | 24/449 |
| 2,728,968 | 1/1956 | Scharff . | |
| 2,764,881 | 10/1956 | Evans . | |
| 2,775,014 | 12/1956 | Gollobin | 63/14.3 X |
| 3,122,007 | 2/1964 | Horland | 63/14.5 X |
| 3,170,212 | 2/1965 | Grosz . | |
| 3,200,614 | 8/1965 | Udry, Jr. | 63/14.5 |

*Primary Examiner*—James R. Brittain
*Attorney, Agent, or Firm*—Blum Kaplan

[57] ABSTRACT

An earring attachable to an earlobe, that varies the gripping pressure applied to the earlobe is provided. A base pivotally supports a clasp so that the clasp grips the ear between the base and the clasp. A pressure controller is slidably mounted on a center prong of the clasp so that by sliding the pressure controller, the gripping pressure of the clasp may be decreased or increased as desired.

16 Claims, 5 Drawing Sheets

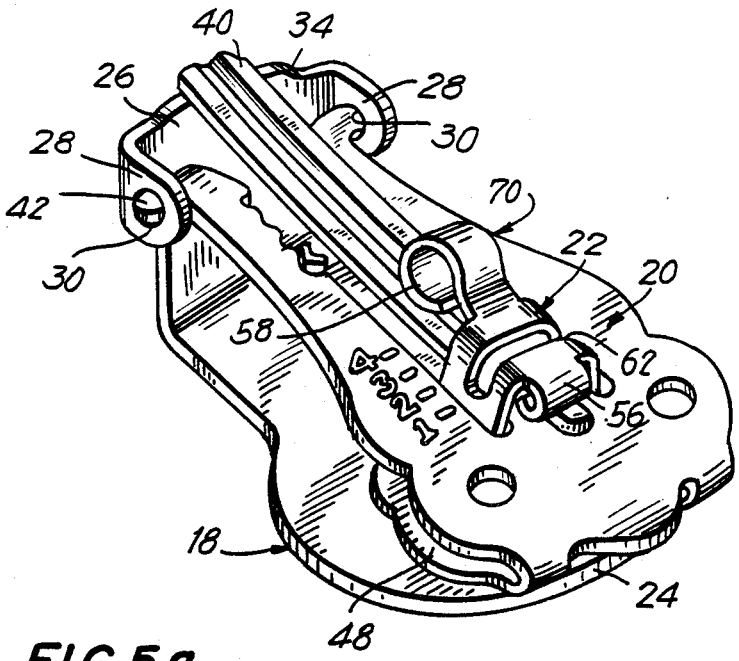
FIG. 5a
FIG. 5b
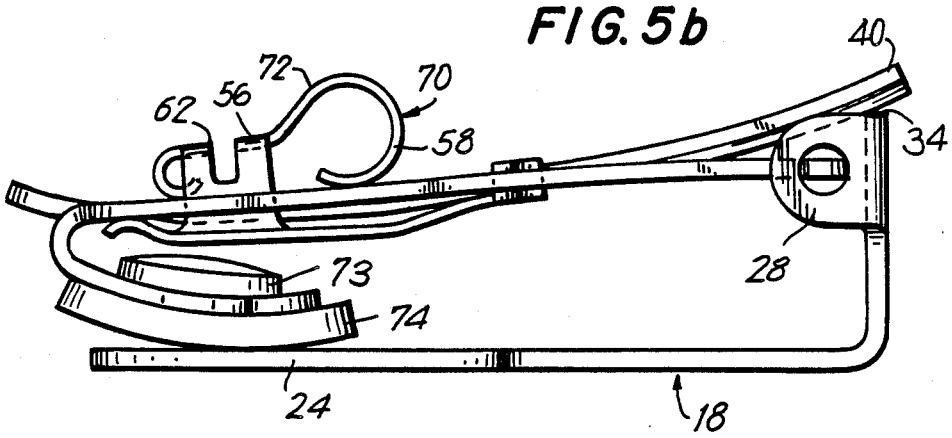

VARIABLE PRESSURE EARRING CLASP

BACKGROUND OF THE INVENTION

This invention is generally directed to an earring clasp, and in particular to a variable pressure earring clasp.

Earrings with clasps are well known. They typically consist of a base which comprises the ornamental portion of the earring. A support is formed at an angle integral with the base. A clasp is pivotally mounted on the support and is biased in the direction of the clasp to selectively retain an earlobe between the base and the clasp. The clasp is biased at a single preset pressure. Such earring clasps have been less than completly satisfactory. Because of the variables of earlobe size and earring weight, the preset pressure is either too high, thereby causing pain and earlobe fatigue or is too low and allows the earring to slip off the ear. It is commonly the practice in the art to provide a high pressure to prevent earring loss.

One type of known earing clasp overcomes the problem of ear fatigue by providing a rubber cushion on the section of the clasp which is brought into contact with the earlobe, thereby cushioning the ear. This type of earing clasp temporarily reduces the pain of earlobe fatigue. However over time earlobe fatigue will result and in some cases too little tension is provided to retain heavier earrings on the earlobe.

Still another known earring clasp is described in U.S. Pat. No. 2,728,968 and is designed to overcome the problem of ear fatigue by providing a slidable solid element on the central tongue of the clasp thereby shortening the length of the middle prong. The slidable element is solid and has the effect of bending the prong at the position it is placed. By shortening the length of the central prong, the pressure applied by the clasp is increased. However the disadvantage with the slidable element is that it deforms the central prong at the set postion after a few uses. Once the central prong is deformed, it is difficult to use the earring at any other desired position.

Accordingly, an earring clasp which is capable of applying a variable pressure to accomodate earlobes of distinct size and shape and the weight of the earring without permanently deforming the earring clasp is provided by the instant invention.

SUMMARY OF THE INVENTION

Generally speaking, in accordance with the instant invention, a variable pressure earring clasp for an earring is provided. The earring includes an ornamental base. A support is formed at an angle integral with the base. A clasp is pivotally supported on the support and is biased in the direction of the base to releasably support an earring on an earlobe. A spring pressure control is supported on the clasp and varies the force with which the clasp is biased in the direction of the ornamental base, in order to permit either a light pressure for preventing earlobe fatigue or a heavy pressure for supporting a heavier earring on the earlobe. In an exemplerary embodiment guage and retainment notches are provided so that the pressure of the clasp can be selectevely maintained at a known pressure.

Accordingly, it is an object of the instant invention to provide an improved earring clasp for an earring.

A further object of the instant invention is to provide an earring clasp for an earring that reduced earlobe fatigue for the user.

Another object of the instant invention is to provide an earring clasp for an earring which extends the durability of the clasp.

Yet another object of the instant invention is to provide a variable pressure earring clasp for an earring which avoids deformation of the earring clasp during use.

Still other objects and advantages of the invention will in part be obvious and in part will be apparent from the specification.

The invention accordingly, comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, which:

FIG. 5*a* is a perspective view of an alternative embodiment of the variable pressure earing clasp of the instant invention; the variable pressure earring clasp;

FIG. 5*b* is a side elevation view of the variable pressure earing clasp of FIG. 5*a;*

DETAILED DESCRIPTION OF THE PREFERRED EMBODIMENTS

Figure 1:
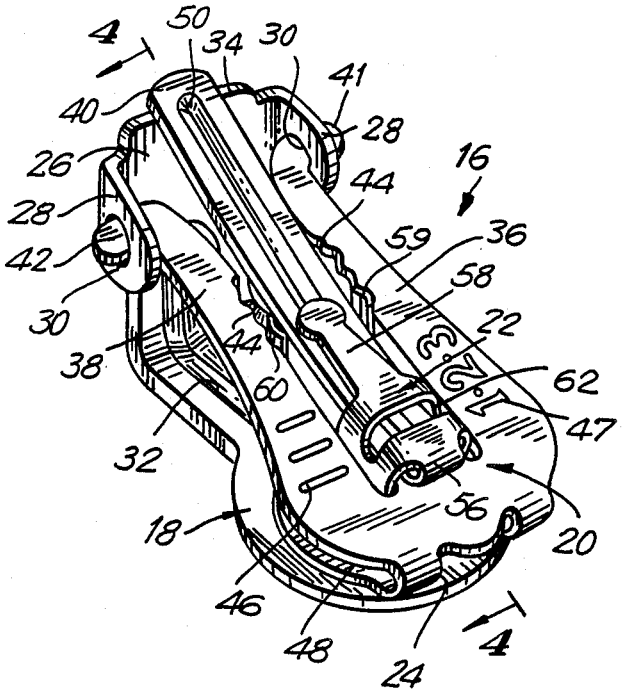
FIG. 1 is a perspective view of the variable pressure earring clasp constructed in acordance with the invention.
Figure 2:
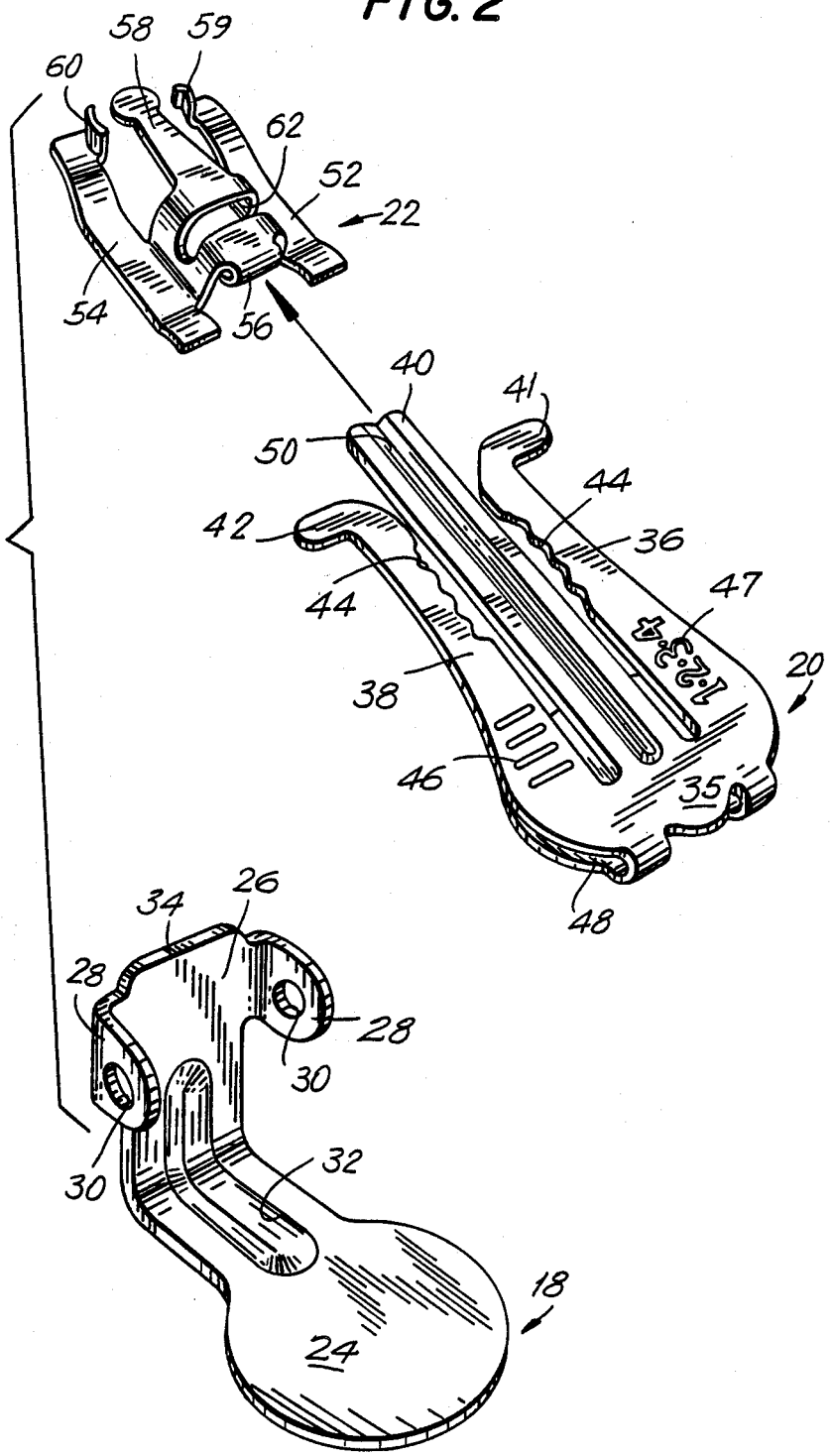
FIG. 2 is an exploded view of the variable pressure earring clasp.

Reference is first made to FIGS. 1 and 2 wherein a variable pressure earring clasp, generally indicated as 16, constructed in accordance with the instant invention, is depicted. Earring 16 is comprised of an ornamental base generally indicated as 18, which supports a clasp generally indicated as 20. A variable pressure controller generally indicated as 22 is slidably mounted on clasp 20.

Base 18 includes a plate 24 which either defines the ornamentation of an earring, or is capable of supporting a separate ornamental configuration (not shown). An upright 26 is integrally formed with plate 24 and extends upright from plate 24 at a substantially right angle. A projection 28 extends from each side of support 26 and each projection 28 has an opening 30 defined therein. Projections 28 are each positioned below the top edge 34. In an exemplary embodiment. A groove 32 is positioned along base 18 and extends along upright 26, groove 32 provides additional strength to base 18 and permits less material to be used to construct the clasp.

Clasp 20 includes a base 35, first prong 36, a second prong 38 extending parallel to prong 36 and a center prong 40 extending between prong 36 and prong 38. Prongs 36, 38, 40 are flexible relative to each other, and project from base 35 and therefore provide a torsional spring action between prong 40 and prongs 36, 38 when prong 40 is displaced relative to prongs 36, 38. A curved foot 41 extends from the end of prong 36 in a direction away from center prong 40. Similarly, a curved foot 42 is formed at the end of prong 38 and extends away from center prong 40. Feet 41 and 42 are received in opening 30 of projections 28 thereby pivotally securing clasp 20 to base 18. Because openings 30 are positioned below top 34 of support 26, center prong 40 is deflected relative to prongs 36, 38, providing a bias in the direction towards plate 24 when clasp 20 is depressed towards plate 24 and a bias away from plate 24 when clasp 20 is pivoted away from plate 24.

In a preferred embodiment, each side prong 36 and 38 is provided with a series of notches 44 along part of its length. A numerical gauge 47 is provided on at least one of the prongs and notched markings corresponding to numerical gauge 47 are formed on the other prong. A pad 48 is affixed to the portion of clasp 20 which comes in contact with the ear of the user. Pad 48 spreads the pressure applied by clasp 20 across the entire surface of the earlobe thereby reducing fatigue caused thereby. A groove 50 extends along the length of center prong 40 which again provides additional strength while conserving material groove 50 also allows for gold or brass electroplating of clasp 20 when variable pressure controller 22 is positioned on prong 40.

Pressure controller 22 includes a first runner 52 and a second runner 54 connected by a central body 56. A prong 58 extends from body 56 between runners 52, 54. Body 56 is elevated above runners 52, 54 so that prong 58 extends from the body and is elevated with respect to runners 52, 54. Prong 58 is flexible and accordingly acts as a leaf spring when pressure is applied hereto. Therefore, a deflection in prong 58 relative to runners 52, 54 provides a downward force through the torsional spring interaction between prong 58 and runners 52, 54. Controller 22 is slidably mounted on clasp 20, such that central body 56 slides over central prong 40 while runners 52, 54 slide under prongs 36, 38 respectively.

A projection 59 extends upright from the end of runner 52 and another projection 60 extends upright from the end of runner 54. Projections 59, 60 cooperate with notches 44 to secure controller 22 at desired tension settings. A slot 62 extends along the width of body 56 and is the same distance away from projections 59, 60 as the distance from each number of guage 47 to the respective notch 44 corresponding to the value of that setting. By this configuration guage 47 and notches 46 may be used to indicate the setting of the desired tension.

Figure 3:
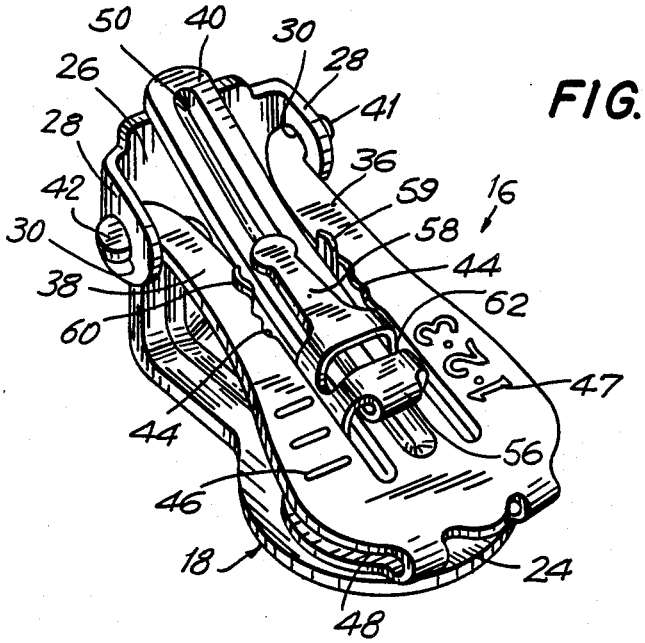
FIG. 3 is a perspective view of the variable pressure earring clasp with the pressure control set for a high pressure.
Figure 4:
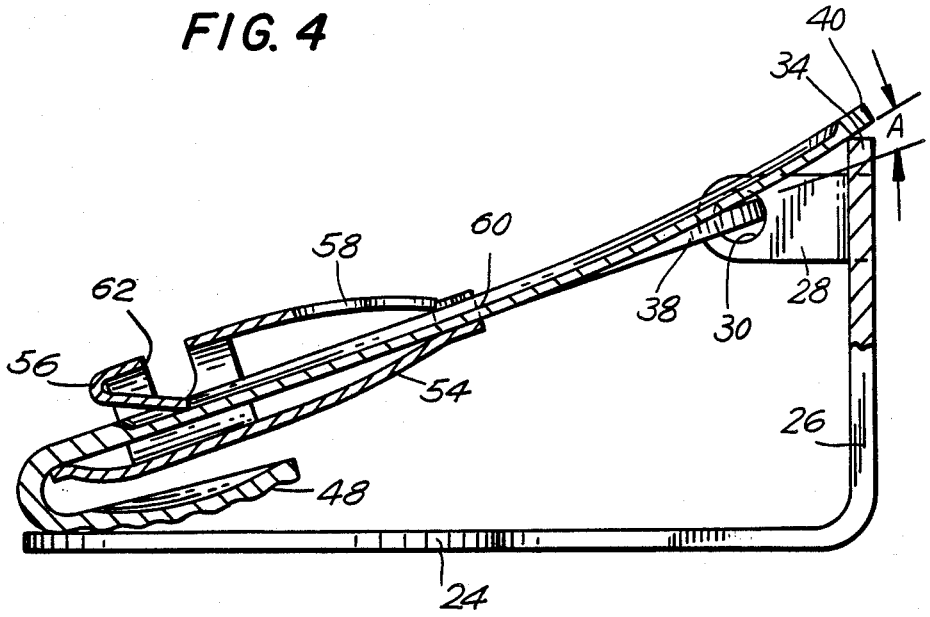
FIG. 4 is a sectional view taken along line 4—4 of FIG. 1.
Figure 5:
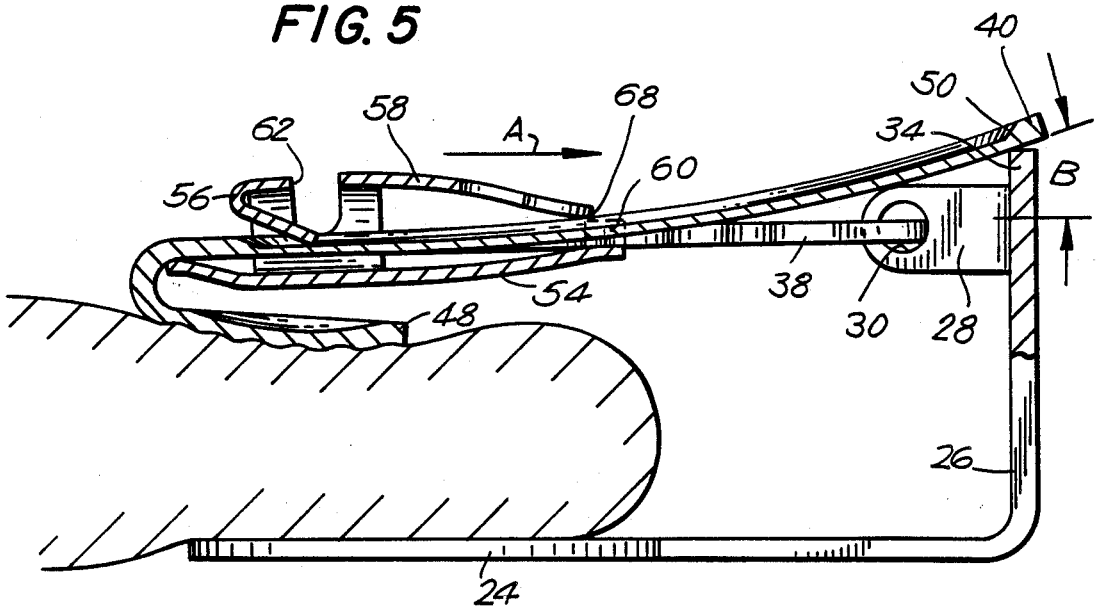
FIG. 5 is a sectional view of the variable pressure earring clasp securing an earlobe.

Reference is now also made to FIGS. 3–5 wherein operation of the earring clasp of the instant invention is depicted. When clasp 20 is supported within projections 28, prong 40 is displaced by top edge 34 from prongs 36, 38. This provides a torsion spring force which biases clasp 20 in the direction of base 18 when clasp 20 is pressed in the direction of base 18. This provides the gripping force for earring 16, holding earring 16 to the earlobe during use. When clasp 20 is pivoted in the direction away from base 18 beyond the point where clasp 20 is substantially perpendicular to support 26, prong 40 returns to a position relatively parallel to prongs 36, 38, thereby biasing clasp 20 to the open position.

The amount of force applied by earring 16 is directly proportional to the angle of deflection between prong 40 and prongs 36, 38. Prong 58 provides a downward force on prong 40, deflecting prong 40 and thereby increasing the deflection angle and in turn the closing force of clasp 20. As pressure controller 22 is slidably displaced in the direction of arrow A, the angle of deflection becomes greater due to the shorter distance between contact position 68 and top edge 34 which in turn, increases the biasing of clasp 20 in the closed direction. Conversely, by sliding pressure controller 22 away from support 26, the gripping force is lessened, hence reducing fatigue in the earlobe. Because prong 58 acts as a spring applying a force at a position on prong 40, prong 58 applies just enough force to deflect prong 40 but not enough to shorten the length of prong 40 or permanently deform prong 40. Increasing the pressure setting also lengthens the duration of time that earing 16 can be utilized because as the material of clasp 20 begins to lose its torsional spring effect with use, controller 22 may be moved to progressively higher settings in order to compensate for the loss in force.

As pressure controller 22 is slid to the desired pressure setting, projections 59, 60 are brought into contact with notches 44 which notches are intended to selectivly retain the tension controller in place at the desired pressure position during use. Simultaneouly, groove 62 aligns with the proper indicating numeral of guage 47 so that a user may easily slide pressure controller 22 to a desired setting.

Reference in now made to FIG. 5*a* wherein a second embodiment of the instant invention is provided. Specifically, prong 58 of controller 22 is formed as a coil 70. The top of coil 58 extends above central body 56 forming a ridge 72. Pushing against ridge 72 during operation facilities the movement of controller 22 along central prong 40. Furthermore, coil 70 provides a greater pressure on central prong 40, thereby providing a greater holding force on the ear than prong 58 when placed at the same spot along central prong 40. Since prong 58 is formed as a coil which extends above central body 56 it continues to act as a spring applying force to prong 40.

Figure 6:
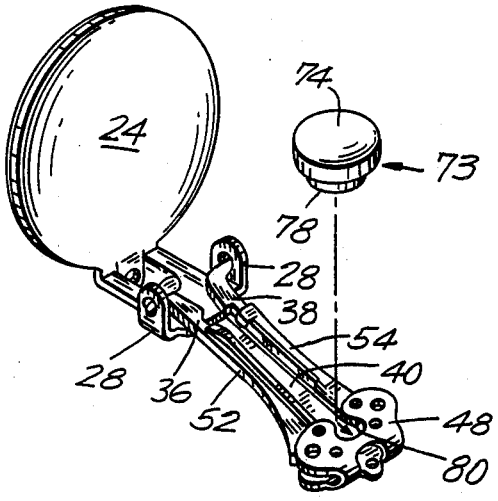
Figure 7:
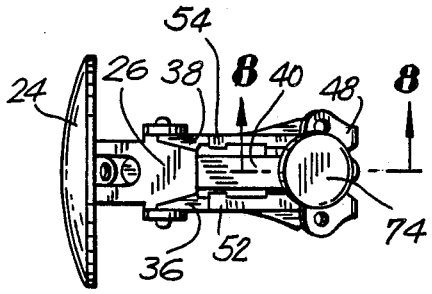
FIG. 7 is a plan view of an alternative embodiment.
Figure 8:
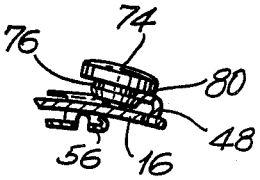
FIG. 8 is a sectional view taken along line 8—8 of FIG. 7.

Reference is now made to the FIGS. 6–8, wherein a third embodiment of the instant invention is depicted. Specifically, a friction pad is mounted on pad 48. A friction pad 73 includes a head 74 a stem 76 extending from below head 74 and a base 78 integrally formed at the bottom of stem 76. The diameter of stem 76 is less than the diameters of both head 74 and base 78. A groove 80 is formed in pad 48 to receive stem 76 of friction pad 73. Because the diameter of base 78 is larger than stem 76 and groove 80, friction pad 73 is anchored to pad 48. Friction pad 73 is made of a material having a high coefficient of friction such as rubber of the like and helps to prevent the earring from slipping off the ear due to the weight of the earring, thereby lessening the need to rely on the pressure applied against the ear by earring clasp 20 as the manner in which earring 16 is held on the ear. This lessens ear fatigue. Furthermore, head 74 of friction pad 73 is also large enough to dissipate the pressure applied to the ear along its entire surface.

Accordingly, by providing an earring having a clasp pivotably mounted and being biased in the closed position by a torsion spring action and a slidable spring controller mounted on the clasp for increasing the torsion action, it is possible to manufacture an earring with a lower initial gripping pressure, that reduces ear fatigue. By providing notches and a guage on the clasp itself, it becomes possible to accurately set the desired torsion for accommodating the needs of the wearer. Furthermore, the spring action of the controller prevents deform- action of the clasp.

It will thus be seen that the objects set forth above, among those made apparent from the preceding description, are efficiently attained and, since certain changes may be made in the above construction without departing from the spirit and scope of the invention, is intended that all matters contained in the above description are shown in the accompanying drawings shall be interpreted as illustrative and not in a limiting sense.

It is understood that the following claims are intended to cover all of the generic and specific features of the invention herein described and all statements of the scope of the invention which, as manner of language, might be said to fall therebetween.

What is claimed is:

1. An earring attachable to an earlobe comprising: a base including a support extending therefrom; clasping means including a clasp pivotably mounted to said base for releasably clasping said base to said ear; said clasp including a first prong that is biased against said support to maintain said base and clasping means in one of an open position and a closed position, a second prong extending from said clasp having top and bottom sides, a third prong extending from said clasp, parallel to said second prong and having top and bottom sides, said second and third prongs pivotally secured to said support, said first prong extending from said clasp between said first and said second prongs, and pressure varying means, slidable on said first prong for effectively varying the bias applied by said clasping means to an earlobe when the clasping means is in said closed position, and clasps said clasping means against said earlobe without substantially deforming the physical properties of said clasping means said pressure varying means including a sliding member slidably mounted on said first prong, a fourth prong connected to and extending from said sliding member toward said support to contact said first prong at a portion of said fourth prong distanced from said sliding member, said fourth prong and said sliding member extending along the length of at least one of said second and third prongs and said sliding member including integral runner means, said fourth prong cooperating with said runner means to bias said first prong and cause said first prong to deflect relative to said second and third prongs and to cause said first prong and said fourth prong to deflect relative to said runner means, said runner means including a first runner extending from below a first side of said sliding member and a second runner extending from below an opposed side of said sliding member and engaging said bottom sides of said third and second prongs respectively.

2. An earring, as claimed in claim 1, wherein a first projection extends from said support and has a hole therein, a second projection extend from said support and has a hole therein, whereby said third prong connects with said first projection and said second prong connects with said second projection and said first prong contacts said support above said first and second projection, whereby said first prong is deflected relative to said third prong and said second prong.

3. An earring, as claimed in claim 2, further comprising an indicator means for indicating the amount of pressure applied by said pressure varying means.

4. An earring, as claimed in claim 2, further comprising retaining means for selectively retaining said pressure varying means at a desired pressure.

5. An earring, as claimed in claim 4, wherein said retaining means comprises a third projection extending at the side of said first runner, a fourth projection extending at the side of said second runner, said third prong having a first plurality of notches therein, said second prong having a second plurality of notches therein, said third projection selectively cooperating with said first plurality of notches in said third prong, and said fourth projection selectively cooperating with said second plurality of notches in said second prong.

6. An earring, as claimed in claim 5, wherein said base is an ornament.

7. An earring, as claimed in claim 6, further comprising a friction means for preventing slippage of the earring from the ear.

8. An earring, as claimed in claim 7, wherein the friction means comprise a pad integrally formed at the end of said clasp opposed to the base when the earring is in the closed position.

9. An earring, as claimed in claim 2, further comprising a friction means for preventing slippage of the earring from the ear.

10. An earring, as claimed in claim 1, further comprising an indicator means for indicating the amount of pressure applied by said pressure varying means.

11. An earring, as claimed in claim 10, wherein said indicator means includes a scale on either of said third prong or said second prong, a series of notches on either of said second prong or of said third prong, said sliding member having a groove therethrough, said groove aligning with said scale.

12. An earring, as claimed in claim 1, further comprising retaining means for selectively retaining said pressure varying means at a desired pressure.

13. An earring, as claimed in claim 12, wherein said base is an ornament.

14. An earring, as claimed in claim 1, further comprising a friction means for preventing slippage of the earring from the ear.

15. An earring, as claimed in claim 14, wherein the friction means comprise a pad integrally formed at the end of said clasp opposed to the base when the earring is in the closed position.

16. An earing, as claimed in claim 1, wherein said fourth prong is formed as a coil.

* * * * *